US007149447B2

(12) United States Patent
Haga

(10) Patent No.: US 7,149,447 B2
(45) Date of Patent: Dec. 12, 2006

(54) IMAGE FORMING DEVICE HAVING AN ELECTRIFYING MEMBER IN CONTACT WITH AN IMAGE CARRIER

(75) Inventor: Masayasu Haga, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 232 days.

(21) Appl. No.: 10/854,427

(22) Filed: May 27, 2004

(65) Prior Publication Data

US 2004/0240900 A1 Dec. 2, 2004

(30) Foreign Application Priority Data

Jun. 2, 2003 (JP) ..... 2003-156322

(51) Int. Cl.
*G03G 15/02* (2006.01)

(52) U.S. Cl. ..... 399/50; 399/89; 399/44; 399/128

(58) Field of Classification Search ..... 399/44, 399/50, 88, 89, 127, 128, 174, 175, 176; 361/221, 225, 230, 235
See application file for complete search history.

(56) References Cited

U.S. PATENT DOCUMENTS 5,420,671 A 5/1995 Kisu et al.
6,014,529 A * 1/2000 Sato ..... 399/50
6,047,145 A * 4/2000 Shigezaki et al. ..... 399/50
6,560,419 B1 * 5/2003 Sugiura ..... 399/50
6,904,253 B1 * 6/2005 Hosokawa et al. ..... 399/176
2002/0041767 A1 * 4/2002 Saito et al. ..... 399/44

FOREIGN PATENT DOCUMENTS

JP 08-160718 6/1996
JP 2002-311690 10/2002

* cited by examiner

*Primary Examiner*—David M. Gray
*Assistant Examiner*—Laura K. Roth
(74) *Attorney, Agent, or Firm*—Morrison & Foerster LLP

(57) ABSTRACT

An image forming device is provided that is capable of easily preventing occurrence of stripe-like image noise that may be caused by intimate contact between a contact electrifying member and an image carrier even when an image forming operation is stopped for a while. In the image forming device having an electrifying roller in contact with a photoconductor, AC voltage is applied to the electrifying roller before the image carrier and the electrifying roller start rotating.

19 Claims, 3 Drawing Sheets

Fig.4

| STOPPING TIME | VOLTAGE APPLYING TIME |
|---|---|
| LESS THAN 6 HOURS | 0.1 SECOND |
| 6 TO 12 HOURS | 0.2 SECONDS |
| 12 TO 24 HOURS | 0.5 SECONDS |
| 24 TO 48 HOURS | 1 SECOND |
| 48 HOURS OR LONGER | 2 SECONDS |

Fig.5

| ABSOLUTE HUMIDITY[g/m$^3$]×STOPPING TIME [h] | VOLTAGE APPLYING TIME |
|---|---|
| 400 OR SMALLER | 0.1 SECOND |
| 400～750 | 0.2 SECONDS |
| 750～4000 | 0.5 SECONDS |
| 1500～3000 | 1 SECOND |
| 3000 OR LARGER | 2 SECONDS |

Fig.6

| ENDURANCE NUMBER OF SHEETS | VOLTAGE APPLYING TIME |
|---|---|
| 500 OR SMALLER | (VALUE OF FIG.4 OR FIG.5) ×1.0 |
| 500～1000 | (VALUE OF FIG.4 OR FIG.5) ×0.5 |
| 1000～5000 | (VALUE OF FIG.4 OR FIG.5) ×0.2 |
| 5000 OR LARGER | (VALUE OF FIG.4 OR FIG.5) ×0.1 |

IMAGE FORMING DEVICE HAVING AN ELECTRIFYING MEMBER IN CONTACT WITH AN IMAGE CARRIER

RELATED APPLICATION

This application is based on Japanese Patent Application No. 2003-156322, the content of which is incorporated herein by reference.

BACKGROUND OF THE INVENTION

The present invention relates to an image forming device having an electrifying member in contact with an image carrier.

For an image forming device having an electrifying member in contact with an image carrier, conventionally, an occurrence of stripe-like image noise may be caused by continuous contact of the electrifying member with the image carrier for a given period of time or longer when the device is at rest. For purpose of preventing the occurrence, a number of techniques of providing a pressure-contact/separation mechanism and thereby canceling the contact between the electrifying member and the image carrier while the device is at rest have been proposed, as disclosed in Japanese Patent Laid-Open Publication No. 2002-311690, for example.

In order to resolve a problem similar to the above, as disclosed in Japanese Patent Laid-Open Publication No. HEI 8-160718, for example, techniques have been proposed in which a frequency of voltage, a peak-to-peak voltage or a current that are applied to an electrifying member is temporarily changed when the device is stopped for a given period of time.

Provision of such a pressure-contact/separation mechanism for an electrifying member as disclosed in the former publication, however, causes a problem in that the provision makes the device complicated and thereby results in cost increase. In the techniques disclosed in the latter publication, image noise that may be caused by deformation of a roller of the electrifying member associated with the pressure contact is prevented by change in various outputs until recovery from the deformation of the roller. The techniques, however, lead to occurrence of peeling discharge because intimate contact between the electrifying member and the image carrier cannot be canceled. The peeling discharge causes electrical charge to be carried partially on the image carrier, and the electrical charge results in non-uniform electrification on a surface of the image carrier and leads to image noise.

SUMMARY OF THE INVENTION

Therefore, an object of the present invention is to provide an image forming device and an image forming method that are capable of easily preventing occurrence of stripe-like image noise that may be caused by intimate contact between a contact electrifying member and an image carrier even when an image forming operation is stopped for a while.

In order to achieve the above object, according to the present invention, there is provided an image forming device comprising:

an image carrier that can be driven to be rotated;

an electrifying member that is provided in contact with the image carrier and that electrifies a surface of the image carrier which is rotating;

an exposure device that exposes the electrified surface of the image carrier to light and thereby forms an electrostatic latent image on the image carrier;

a developing device that has developer therein and that develops the electrostatic latent image; and a transfer device that transfers the developed image onto recording medium;

wherein oscillatory voltage is applied between the electrifying member and the image carrier before the image carrier starts rotating.

In the image forming device of the invention, the electrifying member may be an electrifying roller that is provided so as to be rotated by following the rotation of the image carrier.

In the image forming device of the invention, the oscillatory voltage may be AC voltage or DC pulse voltage.

In the image forming device of the invention, the electrifying roller may be composed of a metal cylinder.

In the image forming device of the invention, the electrifying roller may be an electrifying brush roller.

In the image forming device of the invention, the oscillatory voltage may have peak-to-peak voltage as high as voltage that electrifies a surface of the image carrier.

In the image forming device of the invention, the oscillatory voltage may have peak-to-peak voltage not less than twice as high as a firing potential, between the image carrier and the electrifying member.

In the image forming device of the invention, at least one of applying time, an applied voltage value, and an applied voltage frequency of the oscillatory voltage may be controlled on basis of stopping time of an image forming operation.

In the image forming device of the invention, at least one of the applying time, the applied voltage value, and the applied voltage frequency of the oscillatory voltage may be controlled on basis of absolute humidity.

In the image forming device of the invention, at least one of the applying time, the applied voltage value, and the applied voltage frequency of the oscillatory voltage may be controlled on basis of an endurance number of sheets.

In the image forming device of the invention, at least one of the applying time, the applied voltage value, and the applied voltage frequency of the oscillatory voltage may be controlled on basis of a product of absolute humidity and an endurance number of sheets.

An image forming device in accordance with another aspect of the invention has an image carrier that can be driven to be rotated, and an electrifying member that is provided in contact with a surface of the image carrier and that electrifies the surface of the image carrier which is rotating, wherein the electrifying member is slightly vibrated relative to the image carrier before rotation of the image carrier is started.

According to the present invention, there is provided an image forming method comprising steps of:

applying oscillatory voltage between an image carrier and an electrifying member in contact with a surface of the image carrier;

electrifying the surface of the image carrier while rotating the image carrier after the application of the oscillatory voltage;

exposing the electrified surface of the image carrier to light and thereby forming an electrostatic latent image on the image carrier;

developing the electrostatic latent image by developer; and transferring the image developed on the image carrier onto recording medium.

In the image forming method of the invention, the electrifying member may follow the rotation of the image carrier so as to be rotated in the step of electrifying the surface of the image carrier.

In the image forming method of the invention, the oscillatory voltage may be AC voltage.

In the image forming method of the invention, the oscillatory voltage may be DC pulse voltage.

In the image forming method of the invention, at least one of applying time, an applied voltage value, and an applied voltage frequency of the oscillatory voltage may be controlled on basis of immediately preceding stopping time of an image forming operation.

In the image forming method of the invention, at least one of the applying time, the applied voltage value, and the applied voltage frequency of the oscillatory voltage may be controlled on basis of absolute humidity.

In the image forming method of the invention, at least one of the applying time, the applied voltage value, and the applied voltage frequency of the oscillatory voltage may be controlled on basis of an endurance number of sheets.

In the image forming method of the invention, at least one of the applying time, the applied voltage value, and the applied voltage frequency of the oscillatory voltage may be controlled on basis of a product of absolute humidity and an endurance number of sheets.

In accordance with the image forming device and the image forming method of the invention, oscillatory voltage is applied to the contact electrifying member before the image carrier and the contact electrifying member start rotating, and the contact electrifying member thereby vibrates slightly relative to the image carrier. Thus cancellation of intimate contact between the image carrier and the contact electrifying member prevents peeling discharge and prevents occurrence of stripe-like image noise in an image forming operation that is subsequently performed.

BRIEF DESCRIPTION OF THE DRAWINGS

The present invention will be further described with reference to the accompanying drawings wherein like reference numerals refer to like parts in the several views, and wherein:

FIG. 4 is a table showing an example of control in which voltage applying time is changed according to stopping time;

FIG. 5 is a table showing an example of control in which voltage applying time is changed according to product of absolute humidity and the stopping time; and FIG. 6 is a table showing an example of control in which voltage applying time is changed according to endurance number of sheets.

DETAILED DESCRIPTION OF THE PREFERRED EMBODIMENTS

Figure 1:
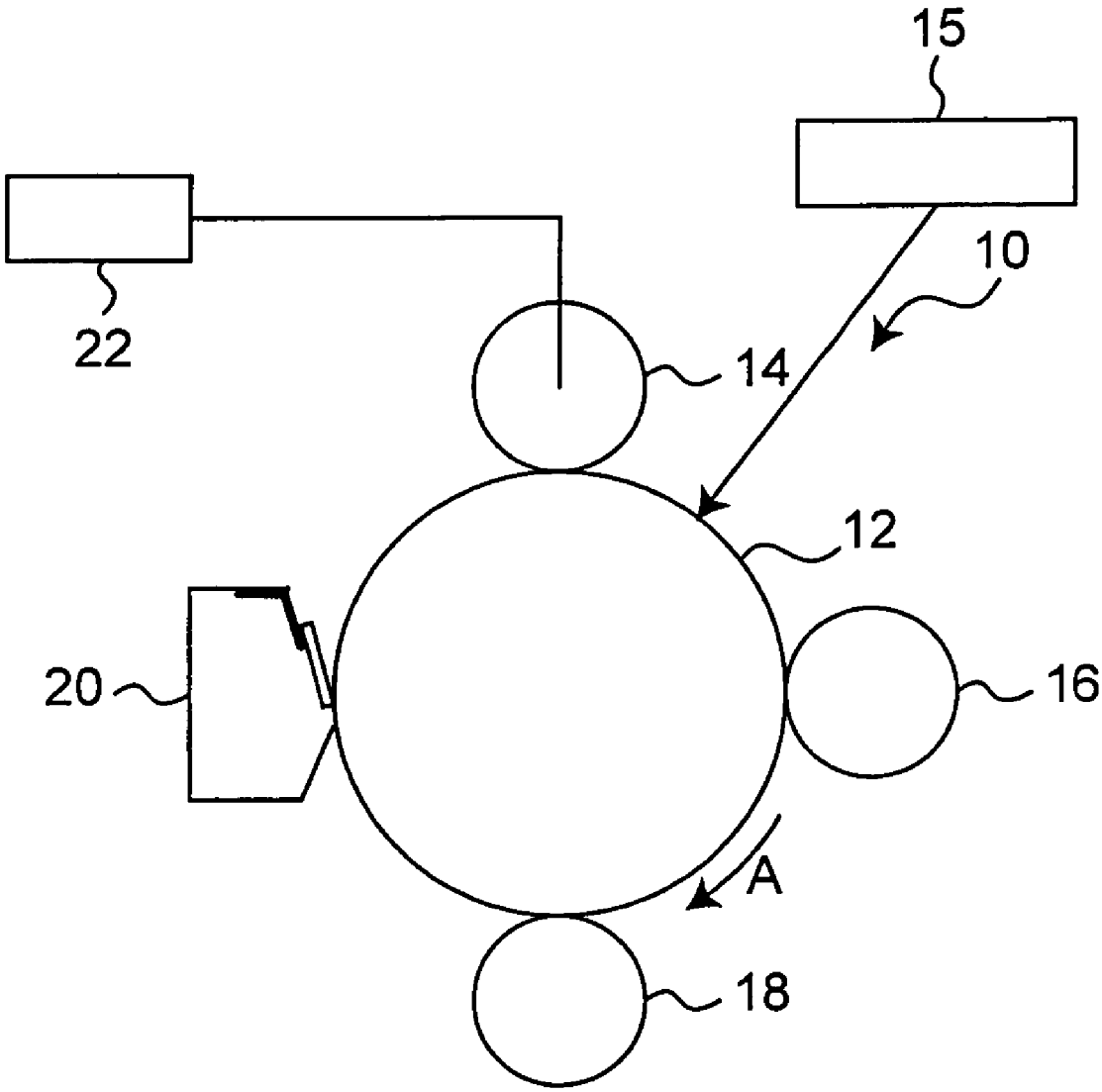
FIG. 1 shows a configuration of a main part of an image forming device.

FIG. 1 shows a main part of an image forming device 10 that is a first embodiment of the invention. The image forming device 10 has a drum-like photoconductor (image carrier) 12. A motor not shown drives the photoconductor 12 to rotate in a direction of an arrow A.

Around the photoconductor 12 are provided an electrifying roller (electrifying member) 14 that is in contact with a surface of the photoconductor 12 and that is rotated by following the rotation of the photoconductor 12, a developing roller (developing device) 16 that uses toner (developer) carried on an outer circumferential surface to develop an electrostatic latent image formed on the surface of the photoconductor 12 and to make the latent image into a toner image, a transfer unit (transfer device) 18 that is in contact with the photoconductor 12 and that transfers the toner image on the photoconductor 12 onto a sheet as recording medium passing between the photoconductor 12 and the unit, and a cleaning unit 20 that retrieves toner remaining on the surface of the photoconductor 12 after the transfer, in order of mention along the direction of rotation of the photoconductor 12.

The electrifying roller 14 composed of a metal cylinder or a conductive brush roller, for example, is electrically connected to a power source 22. The power source 22 is capable of applying to the electrifying roller 14 voltage in which AC voltage is superimposed on DC voltage, and on-off control over the DC voltage and the AC voltage can separately be performed by the power source 22.

Hereinbelow, an image forming operation of the image forming device 10 with the above configuration will be described. In the image forming operation, the photoconductor 12 is driven to rotate in the direction of the arrow A, and the electrifying roller 14 follows the photoconductor 12 to rotate concomitantly. Oscillatory voltage in which AC voltage is superimposed on DC voltage is applied to the electrifying roller 14 by the power source 22, and discharge occurring in a minute space between the electrifying roller 14 and the surface of the photoconductor 12 uniformly electrifies the surface of the photoconductor 12.

The uniformly electrified surface of the photoconductor 12 is exposed to light according to image data by an exposure device 15, and an electrostatic latent image is thereby formed on the surface of the photoconductor 12. When the electrostatic latent image comes to the developing roller 16 with the rotation of the photoconductor 12, toner carried on the outer circumferential surface of the developing roller 16 adheres to the electrostatic latent image, so that a toner image is developed and formed.

When the toner image formed on the surface of the photoconductor 12 comes to the transfer unit 18, a sheet is synchronously introduced between the photoconductor 12 and the transfer unit 18, and the toner image on the photoconductor 12 is transferred onto the sheet by suction with an electrostatic force that is caused by voltage applied to the transfer unit 18. The sheet onto which the toner image has been transferred is passed through a fixation unit not shown, and the toner image is thereby heated and fixed on the sheet. The sheet is thereafter ejected from the image forming device.

Toner remaining on the surface of the photoconductor 12 after the toner image is transferred onto the sheet is scraped off and retrieved by a blade in the cleaning unit 20.

Hereinbelow, control over voltage that is applied to the electrifying roller 14 in the image forming device 10 will be described.

In status in which the power source has been turned off and the image forming device 10 has been stopped for a long term or in which an image forming operation has been stopped for a while in replacement of cartridges (e.g., imaging cartridges or toner cartridges) or in printing standby status between jobs, the image forming operation is started upon power-on or reception of a printing instruction.

Figure 2:
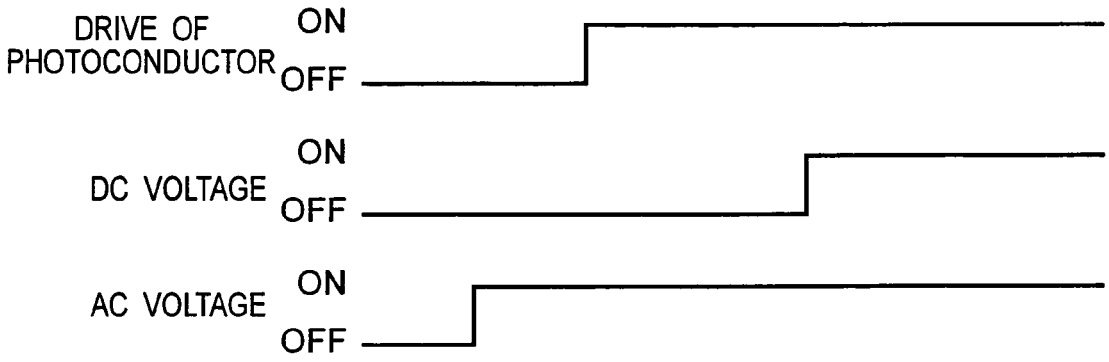
FIG. 2 is a chart showing timing of start of drive of a photoconductor and of application of voltage to an electrifying roller in a first embodiment.

When the image forming operation is started, the photoconductor 12 and the electrifying roller 14 are initially started rotating. Before the photoconductor 12 starts rotating, AC voltage (oscillatory voltage) is applied to the electrifying roller 14, as shown in FIG. 2. Then, the rotational drive of the photoconductor 12 is started one second later, for example, and application of DC voltage to the electrifying roller 14 is started after one revolution of the photoconductor 12, for example. The AC voltage that is applied prior to the drive of the photoconductor 12 may have the same output as in image formation (e.g., peak-to-peak voltage of 1.5 kV) or may be not less than twice as high as a firing potential (e.g., peak-to-peak voltage of 1.0 kV).

The oscillatory voltage is applied to the electrifying roller 14 with such timing prior to the rotation of the photoconductor 12 and the electrifying roller 14, so that the electrifying roller 14 slightly vibrates relative to the photoconductor 12. Thus cancellation of the intimate contact between the photoconductor 12 and the electrifying roller 14 prevents the peeling discharge and prevents occurrence of stripe-like image noise in the image forming operation that is subsequently performed.

A shape of the AC voltage is not limited to a sinusoidal wave but may be oscillatory voltage having other shapes such as triangular wave and rectangular wave.

The timing of the application of the DC voltage is preceded by the drive of the photoconductor 12 in the above; however, the timing may be synchronized with the application of the AC voltage. The DC voltage in this case is required to be set at 0 V or generally at 0 V at beginning of the application.

In the above, the AC voltage is applied one second before the drive of the photoconductor 12 is started. Status of the intimate contact between the photoconductor 12 and the electrifying roller 14, however, varies with image forming operation stopping time, environment, service conditions (such as endurance number of sheets) of the image forming device 10, and the like, and therefore at least one of applying time, a value, and a frequency of the AC voltage may be controlled on basis of at least one of those factors. In this manner, the voltage can be set that is required for canceling the intimate contact between the photoconductor 12 and the electrifying roller 14, and a load on the photoconductor 12 that is caused by the application of the voltage can be minimized.

As the image forming operation stopping time (that will be referred to simply as "stopping time," hereinbelow), there can be enumerated "a period of time for which the device is stopped for a long term after the power source is turned off," "a period of time for which an image forming operation is stopped for a while in the replacement of cartridges," and "printing standby time between jobs," as described above, for example. As a method of measuring such stopping time, there may be used (i) a method in which a timer is activated simultaneously when the drive of the photoconductor is stopped and in which time having elapsed till the drive of the photoconductor is resumed is counted by the timer, (ii) a method in which time and date when the drive of the photoconductor is stopped are stored and in which the stopping time is calculated on basis of a difference between the time and date and those when the drive of the photoconductor is resumed, and the like. For such calculation of time, the timer, a clock and a storage device for the storage of the time and date, and the like are provided as necessary in the image forming device. Oscillatory voltage applying conditions can be determined on basis of the stopping time measured in this manner and on basis of a correspondence table or a calculation formula between the stopping time and the oscillatory voltage applying conditions (voltage applying time, applied voltage value, and applied voltage frequency) that has been stored in advance in the image forming device.

As environmental conditions, there can be enumerated absolute humidity and temperature. For measurement of those, absolute humidity sensors, temperature sensors or the like are provided as necessary in the image forming device. The oscillatory voltage applying conditions can be determined on basis of at least one of those measurements and on basis of a correspondence table or a calculation formula between the environmental conditions and the oscillatory voltage applying conditions that has been stored in advance in the image forming device.

The endurance number of sheets means "a total number of sheets on which images have been formed with use of the electrifying member (the electrifying roller) to which the oscillatory voltage is to be applied and with use of the image carrier (the photoconductor) confronting the member." The endurance number of sheets is measured by a counter provided in the image forming device, and the oscillatory voltage applying conditions can be determined on basis of the measurement and on basis of a correspondence table or a calculation formula that has been stored in advance in the image forming device.

FIGS. 4, 5 and 6 show specific examples of the control over the AC voltage applying time prior to the drive of the photoconductor 12. FIG. 4 is an example in which the voltage applying time is changed according to the stopping time. FIG. 5 is an example in which the voltage applying time is changed according to product of absolute humidity as an environmental condition and the stopping time. FIG. 6 is an example in which the voltage applying time is determined as a control value in FIG. 4 or FIG. 5 multiplied by correction factors (1.0, 0.5, 0.2, 0.1) according to the endurance number of sheets. With the control over the voltage applying time in this manner, the intimate contact between the photoconductor 12 and the electrifying roller 14 can be canceled by application of a necessity minimum of voltage.

Hereinbelow, an image forming device of a second embodiment of the invention will be described. The image forming device of the second embodiment has generally the same configuration as the image forming device 10 of the first embodiment described above has, except that a power source 22 is capable of applying only DC voltage to an electrifying roller 14. Therefore, description of the configuration and an image forming operation of the image forming device of the second embodiment is omitted.

Figure 3:
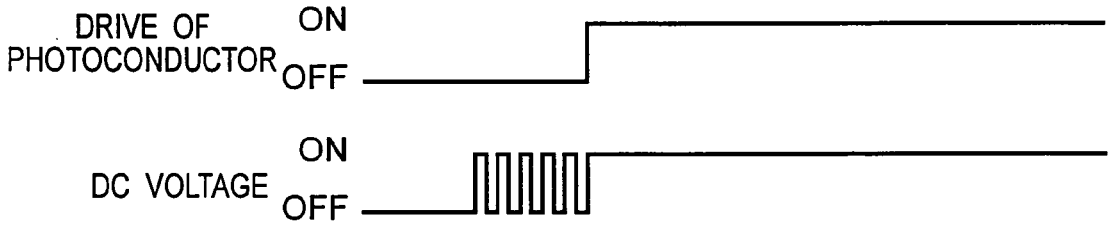
FIG. 3 is a chart showing timing of start of drive of a photoconductor and of application of voltage to an electrifying roller in a second embodiment.

FIG. 3 shows on-timing of drive of a photoconductor 12 and of voltage application to the electrifying roller 14 in the image forming device of the second embodiment. In this case, the power source 22 starts applying DC pulse voltage to the electrifying roller 14 one second before the drive of the photoconductor 12 is started, for example. The DC pulse voltage is oscillatory voltage alternating between −800 V and 0 V by switching at a frequency of 50 Hz, for example.

In synchronization with the start of the drive of the photoconductor 12, the DC voltage that is applied to the electrifying roller 14 is fixed. Even though the Dc pulse voltage is thus applied before the photoconductor 12 is driven, cancellation of intimate contact between the photoconductor 12 and the electrifying roller 14 in a manner similar to the image forming device 10 prevents the peeling discharge and prevents occurrence of stripe-like image noise in an image forming operation that is subsequently performed.

In the image forming device of the second embodiment, the DC pulse voltage is applied one second before the drive of the photoconductor 12 is started. Status of the intimate contact between the photoconductor 12 and the electrifying roller 14, however, varies with image forming operation stopping time, environment, service conditions (such as endurance number of sheets) of the image forming device 10, and the like, and therefore at least one of applying time, values, and a frequency of the DC pulse voltage may be controlled on basis of at least one of those factors. In this manner, the voltage can be set that is required for canceling the intimate contact between the photoconductor 12 and the electrifying roller 14, and a load on the photoconductor 12 that is caused by the application of the voltage can be minimized.

With the control over the applying time of the DC pulse voltage prior to the start of the drive of the photoconductor 12 in such a manner as shown in FIGS. 4, 5 and 6, the intimate contact between the photoconductor 12 and the electrifying roller 14 can be canceled by application of a necessity minimum of voltage.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming device comprising:

an image carrier that can be driven to be rotated;

an electrifying member that is provided in contact with the image carrier and that electrifies a surface of the image carrier which is rotating;

an exposure device that exposes the electrified surface of the image carrier to light and thereby forms an electrostatic latent image on the image carrier;

a developing device that has developer therein and that develops the electrostatic latent image; and a transfer device that transfers the developed image onto recording medium;

wherein an oscillatory voltage consisting of only AC voltage or only a DC voltage pulse is applied between the electrifying member and the image carrier before the image carrier starts rotating.

2. The image forming device as claimed in claim 1, wherein the electrifying member is an electrifying roller that is provided so as to be rotated by following rotation of the image carrier.

3. The image forming device as claimed in claim 2, wherein the electrifying roller is composed of a metal cylinder.

4. The image forming device as claimed in claim 2, wherein the electrifying roller is an electrifying brush roller.

5. The image forming device as claimed in claim 1, wherein the oscillatory voltage has peak-to-peak voltage as high as voltage that electrifies the surface of the image carrier.

6. The image forming device as claimed in claim 1, wherein the oscillatory voltage has peak-to-peak voltage not less than twice as high as a firing potential, between the image carrier and the electrifying member.

7. The image forming device as claimed in claim 1, wherein at least one of applying time, an applied voltage value, and an applied voltage frequency of the oscillatory voltage are controlled on basis of stopping time of an image forming operation.

8. The image forming device as claimed in claim 1, wherein at least one of applying time, an applied voltage value, and an applied voltage frequency of the oscillatory voltage are controlled on basis of absolute humidity.

9. The image forming device as claimed in claim 1, wherein at least one of applying time, an applied voltage value, and an applied voltage frequency of the oscillatory voltage are controlled on basis of an endurance number of sheets.

10. The image forming device as claimed in claim 1, wherein at least one of applying time, an applied voltage value, and an applied voltage frequency of the AC voltage or DC voltage pulses are controlled based on a product of absolute humidity and an image forming operation stopping time.

11. An image forming device comprising:

an image carrier that can be driven to be rotated;

an electrifying member that is provided in contact with the image carrier and that electrifies a surface of the image carrier which is rotating;

an exposure device that exposes the electrified surface of the image carrier to light and thereby forms an electrostatic latent image on the image carrier;

a developing device that has developer therein and that develops the electrostatic latent image; and a transfer device that transfers the developed image onto recording medium;

wherein oscillatory voltage is applied between the electrifying member and the image carrier before the image carrier starts rotating, and wherein at least one of applying time, an applied voltage value, and an applied voltage frequency of the oscillatory voltage are controlled based on a product of absolute humidity and an endurance number of sheets.

12. An image forming device comprising:

an image carrier that can be driven to be rotated; and an electrifying member that is provided in contact with a surface of the image carrier and that electrifies the surface of the image carrier which is rotating;

wherein the electrifying member is slightly vibrated relative to the image carrier before the image carrier starts rotating by an application of only an AC voltage or only a DC voltage pulse between the electrifying member and the image carrier.

13. An image forming method comprising steps of:

applying an oscillatory voltage consisting of only AC voltage or only a DC voltage pulse between an image carrier and an electrifying member in contact with a surface of the image carrier;

electrifying the surface of the image carrier while rotating the image carrier after the application of the oscillatory voltage;

exposing the electrified surface of the image carrier to light and thereby forming an electrostatic latent image on the image carrier;

developing the electrostatic latent image by developer; and transferring the image developed on the image carrier onto recording medium.

14. The image forming method as claimed in claim 13, wherein the electrifying member is rotated by following rotation of the image carrier in the step of electrifying the surface of the image carrier.

15. An image forming method as claimed in claim 13, wherein at least one of applying time, an applied voltage value, and an applied voltage frequency of the oscillatory voltage are controlled on basis of immediately preceding stopping time of an image forming operation.

16. The image forming method as claimed in claim 13, wherein at least one of applying time, an applied voltage value, and an applied voltage frequency of the oscillatory voltage are controlled on basis of absolute humidity.

17. The image forming method as claimed in claim 13, wherein at least one of applying time, an applied voltage value, and an applied voltage frequency of the oscillatory voltage are controlled on basis of an endurance number of sheets.

18. The image forming device as claimed in claim 13, wherein at least one of applying time, an applied voltage value, and an applied voltage value, and an applied voltage frequency of the AC voltage or DC voltage pulses are controlled based on a product of absolute humidity and an image forming operation stopping time.

19. An image forming method comprising:

applying an oscillatory voltage consisting of only AC voltage or only a DC voltage pulse between an image carrier and an electrifying member in contact with a surface of the image carrier;

electrifying the surface of the image carrier while rotating the image carrier after the application of the oscillatory voltage;

exposing the electrified surgace of the image carrier to lighty and thereby forming an electrostatic latent image on the image carrier;

delveloping the electrostatic latent image by developer; and transferring the image developed on the image carrier onto recording medium;

wherein oscillatory voltage is applied between the electrifying member and the image carrier before the image carrier starts rotating and wherein at least one of applying time, an applied voltage value, and an applied voltage frequency of the AC voltage or DC voltage pulses are controlled based on a product of absolute humidity and an endurance number of sheets.

* * * * *